United States Patent [19]

Norén

[11] Patent Number: 4,532,007

[45] Date of Patent: Jul. 30, 1985

[54] USE OF SUBSTANCES GIVING OFF OXYGEN IN REDUCTION OF DARK COLORING OF PULP

[75] Inventor: Per-Olle Norén, Norrköping, Sweden

[73] Assignees: Holmens Bruk Aktiebolag, Norrköping, Sweden; L'Air Liquide S.A. pour l'Etude et Exploitation des Procedes Georges Claude, Paris, France

[21] Appl. No.: 498,199

[22] PCT Filed: Sep. 20, 1982

[86] PCT No.: PCT/SE82/00286

§ 371 Date: May 20, 1983

§ 102(e) Date: May 20, 1983

[87] PCT Pub. No.: W083/01080

PCT Pub. Date: Mar. 31, 1983

[30] Foreign Application Priority Data

Sep. 22, 1981 [SE] Sweden ..... 8105591

[51] Int. Cl.[3] ..... D21F 1/66

[52] U.S. Cl. ..... 162/161; 162/190; 210/764; 210/928

[58] Field of Search ..... 162/190, 192, 161; 210/928, 759, 760, 764, 765

[56] References Cited

U.S. PATENT DOCUMENTS

| | | | |
|---|---|---|---|
| 3,405,930 | 10/1968 | Morter | 162/161 |
| 3,514,278 | 5/1970 | Brink, Jr. | 71/67 |
| 3,578,610 | 4/1971 | Mader et al. | 162/79 |
| 3,876,497 | 4/1975 | Hoffman | 162/189 |

OTHER PUBLICATIONS

ABIPO, vol. 51, No. 1, 7/80, #642.

Wenzl, J. H., "Closure of Paper & Board Mill Production Systems and its Effect on Production Conditions", Tappi Annual Meeting, Mar. 1981.

*Primary Examiner*—William F. Smith

*Attorney, Agent, or Firm*—Cushman, Darby & Cushman

[57] ABSTRACT

Use of oxygen, oxygen containing gases or substances giving off oxygen in reduction or inhibition of the dark coloring of pulp or paper in white water systems, especially closed ones, in production of pulp and paper, these substances being added to the white water system in such an amount that aerobic conditions are maintained substantially permanently in at least a part of the white water system, i.e. the redox potential is higher than −100 mV.

3 Claims, 2 Drawing Figures

USE OF SUBSTANCES GIVING OFF OXYGEN IN REDUCTION OF DARK COLORING OF PULP

Figure 1:
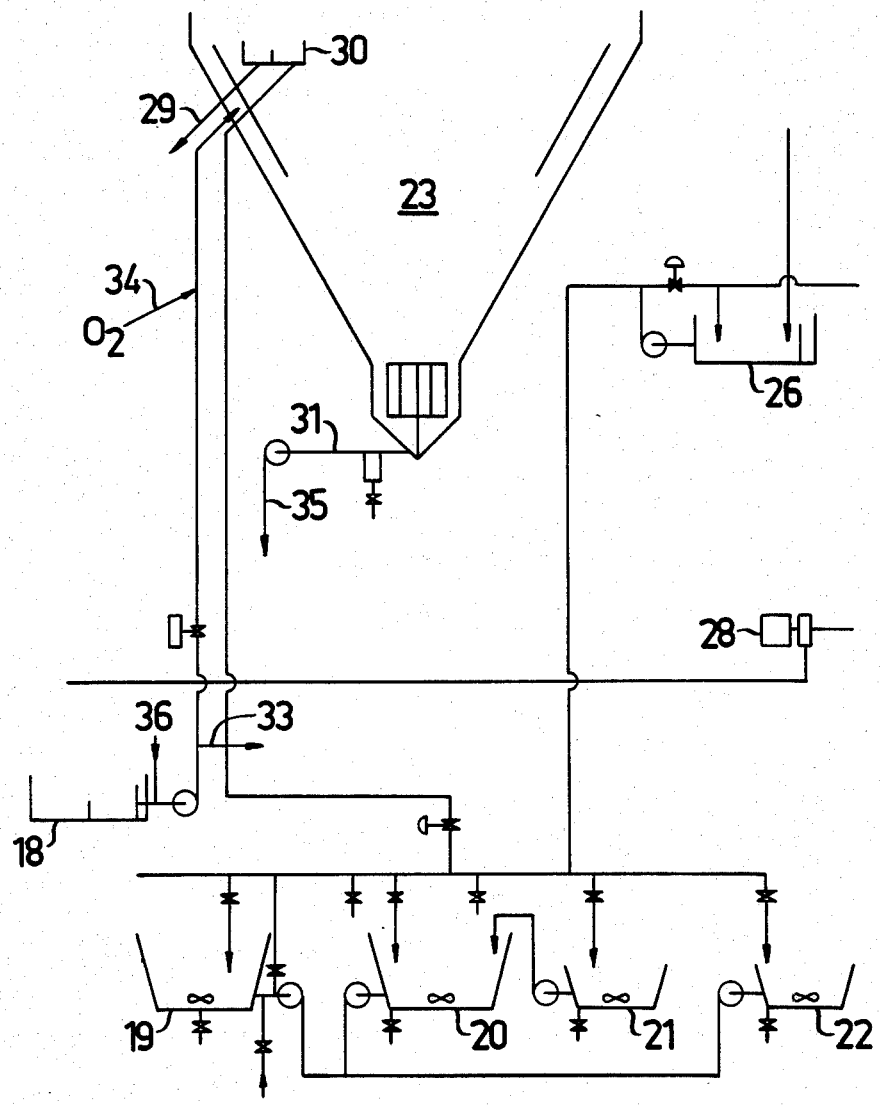

In the pulp and paper industry, possibly except the kraft paper industry, as little discolouration as possible is desired, as the finished products should have a high brightness (whiteness). One reason of discolouration may be the brown colouring, which the pulp exhibits at a high temperature due to certain oxidation processes. The reaction products formed can however be degraded by bleaching, chlorine, peroxide or dithionite but also oxygen being used as a bleaching agent.

Now, it has been found that pulp (paper) is discoloured by dark colouring in certain cases. Previously, this discolouration has not been so embarassing that it has been a problem or caused any measures. The tendency of closing the process systems, i.e. reducing the water consumption in the process, seems, however, to have led to an increase of this discolouration.

It has now been shown that the use of oxygen, oxygen containing gases or substances giving off oxygen reduce or inhibit the dark colouring in production of pulp and paper, these substances being added to whitewater systems, especially closed ones in such an amount that aerobic conditions are maintained substantially permanently in at least a part thereof, conveniently at least 50% and preferably the major portion thereof, e.g. 75–90% thereof, or substantially the whole whitewater system, i.e. that the redox potential (Eh) is kept higher than about −100mV or that it does not sink below −120mV more than occasionally or at any rate not below −140 to −160mV, say −150mV. It has been found that a suitable feed is in the form of air or other oxygen containing gases, as well as pure oxygen gas. It has also appeared to be possible to use substances giving off oxygen such as peroxides, e.g. hydrogen peroxide.

In the closed whitewater systems from paper preparation or transport water of pulp, which is completely or partly recirculated (re-used) it has appeared that the best results are obtained if so much oxygen is added that some amount of the oxygen is constantly maintained in the water or that the water is substantially free of oxygen for a time that is not so long. Satisfactory results are achieved if oxygen is added to the water at least once during the circulation in such an amount that a substantial excess of oxygen remains at least immediately after the place of addition, e.g. up to 1 hour after the addition or at least for about 20 min.

It has been found that this addition of oxygen does not act as a bleaching agent, i.e. it does not degrade organic reaction products formed. It seems instead as if the mechanism at this discolouration and its removal lies in the fact that metals, above all iron, which is released from the process apparatus during the circulation of the pulp, stock or the water, react with sulfides, especially hydrogen sulfide, to form metal sulfides, such as iron sulfide. Of course the metals may also come from other sources, e.g. the wood substance. Sulfur is mainly present as sulfate and is mostly added to the process in different forms, e.g. sulfuric acid, sodium bisulfite and aluminum sulfate (alum). All the sulfate will above all form hydrogen sulfide under the influence of anaerobic bacteria, e.g. such ones from the group of desulfovibrio bacteria. Thus, the mechanism is apparently quite another than a thermally conditioned oxidation. This also explains why this discolouration previously has not been embarrasing in a high degree. This closing of the process systems which has now been the consequence i.a. of increased requirements on waste water treatment in factories has however increased the content of dissolved, organic substances in the system. These are easily oxidized and any free oxygen is then consumed, life conditions being obtained for anaerobic bacteria. Moreover, these organic substances are suitable as nutrition for these bacteria.

The life cycle of the anaerobic bacteria seems to be interrupted by the present invention, the formation of dark colouring metal sulfides, especially iron sulfide, being reduced to a large extent.

The invention is illustrated more in detail in the following examples, which are not limiting the scope of the invention.

EXAMPLE 1

Large scale tests have been carried out, thermomechanical pulp in concentration of about 1% being transported about 8 km in a closed pipeline. The thermomechanical pulp was prepared substantially from spruce. The transported amount was 25 $m^3$/min, of which 19 $m^3$/min were recycled and used again as transport water; the residue was discharged after purification. Typical analyses show a sugar content of 100–200 mg/l, e.g. 110–150 mg/l, a substantially neutral pH, e.g. 5–7, e.g. 6.2–6.7, a $SO_4$-content of 100–1000 mg/l, e.g. 250–700 mg/l, a Fe-content of 0.5–2.0 mg/l, e.g. 1.0–1.5 mg/l and a Cu-content of 0.5–1.5 mg/l, e.g. 0.6–1.2 mg/l. These concentrations have been substantially equal in the pulp slurry as well as the transport water.

Without the use of the present invention the brightness of the pulp was reduced from the place of preparation to the dewatering place from about 59 to about 56 units, e.g. a reduction of about 5%. At tests with addition of oxygen by bubbling through pure oxygen in such an amount (about 20 g $O_2$ per $m^3$ water) that free oxygen could be proved in the water about 6 km after the place of addition, substantially the same whiteness (between 57 and 58 units) as maintained at the place of preparation as well as that of dewatering.

EXAMPLE 2

Figure 2:
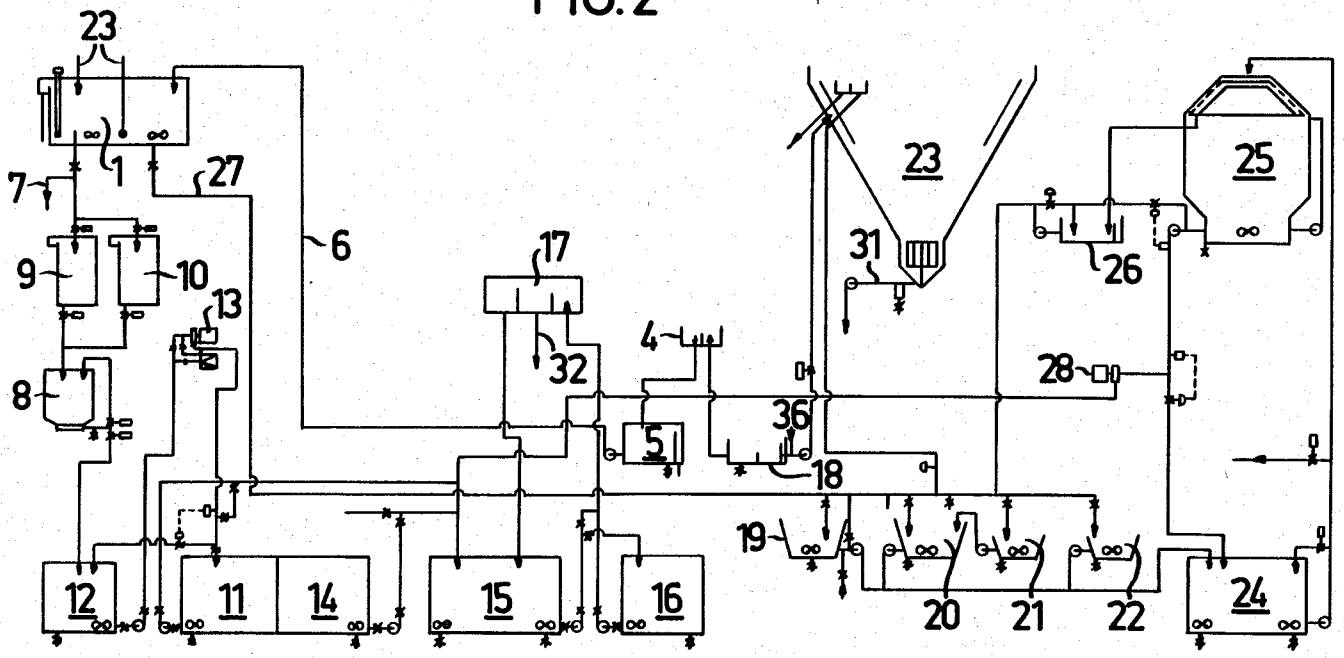

The invention is further illustrated referring to the attached drawings on which FIG. 1 is a schematic partial view of a paper machine system. FIG. 2 is a schematic view of pulp and broke pulp systems of a conventional paper machine.

In FIG. 2 from the left is seen a white water tank 1 with supply of fresh water and steam 2 and 3, respectively. Furthermore, white water is conducted from the wire channel 4 through a white water receptacle 5 through a line 6 to this white water tank 1. The white water in this white water tank 1 is further conducted to screen room through a line 7 and used in pulper 8; the white water being conducted through metering tanks 9 and 10, and the pulp from pulper 8 being conducted to a pulp tank 11, preferably a tank for chemical pulp, through a dumping tank 12 and refiner 13. Besides the chemical pulp tank 11 there is provided a tank 14 for mechanical pulp, preferably thermomechanical pulp. To these pulp tanks 11 and 14 pulp from other sources also can be added, as e.g. reject pulp or pulp from an integrated pulp mill. From these pulp tanks the pulp is pumped to a machine chest 15, to which also can be added colour, size, clay, broke and reject, for instance. From this machine chest 15 the pulp is pumped to a stock supply tank 17 and/or to another machine chest 2, from which the pulp also is pumped to the stock supply tank 17. From an overflow the excess pulp is conducted back to the machine chest 15. From this stock supply tank 17 the head box of the machine is supplied with stock 32.

In FIG. 2 the broke and white water processing is further illustrated. The paper machine is very schematically shown by wire channel 4, suction box water receptacle 18, couch pit 19, reel up pit 20, winder pits 21 and 22, respectively. The water from the suction boxes is collected in the suction box water receptacle 18 and together with the water from the wire channel 4. Water from the suction box water receptacle 18 is together with added alum conducted to a settling funnel 23. Broke from the couch pit 19, the reel up pit 20 and the winder pits 21 and 22 is conducted to a broke chest 24 for further broke processing or, if desired, back to the machine chest 15. From the broke chest 24 the broke can also be pumped to a broke tank 25 and concentrated, the white water from the concentration being conducted to a white water chest 26, the white water of which can be used to flushing the broke from the couch, the reel up or the winders, as indicated. For this flushing white water from the white water tank 1 also can be used, as indicated by line 27. The broke from broke tank 25 can be processed in refiner 28 and conducted to machine chest 15.

In FIG. 1 the function of the settling funnel 23 and devices connected thereto is further illustrated. From the suction box water receptacle 18 the water is pumped together with alum for instance, added at 36 to settling funnel 23. The residence time in the settling funnel 23 is about 24 hours. The fibres are settled and clear water is drawn off at 29 and also a pressure head is maintained at 30 for the white water tank 1. The fibre sediment is drawn off at 31 to the stock supply of the paper machine together with the pulp from the outlet 32 from the stock supply tank 17 and white water from wire channel 4.

As the residence time is as long as about 24 hours there is a tendency for the pulp to darken. In an experiment pulp samples were taken out at 33 and gaseous oxygen injected at 34 and samples were also taken out of the sediment conduit 31 at a point 35. During the experiment the oxygen flow was 3.9 $m^3/h$ (5.4 kg/h) on average; the fibre concentration in the white water to the settling funnel was about 0.6 g/l; the fibre concentration in sediment from the funnel 23 was 2.6 g/l; the brightness of white water conducted to the funnel 23 was before experiment 55.0% and increased to the 58.8% when equilibrium was reached; a brightness if the sediment from the funnel 23 was before experiment 57.4% and increased to 60.0% when equilibrium was reached; the paper produced on the machine had during the experiment a brightness of 67.0%.

I claim:

1. In the production of paper, a method of reducing discoloration of paper pulp in closed white water systems due to the presence of metal sulfides where the metal sulfides are produced by the reaction of metal ions present in the system with hydrogen sulfide, the hydrogen sulfide being produced under the influence of anaerobic microorganisms with sulfates, the method comprising maintaining aerobic conditions within said closed white water system at a redox potential higher than −100mV by introducing oxygen or oxygen-containing gases thereby inhibiting growth of said anaerobic microorganisms.

2. The method according to claim 1 wherein the microorganism is bacteria.

3. The method according to claim 1 wherein the metal sulfide is a sulfide of iron.

* * * * *